US006095889A

United States Patent [19]

Demarinis

[11] Patent Number: 6,095,889

[45] Date of Patent: Aug. 1, 2000

[54] INTERACTIVE ENTERTAINMENT DEVICE

[76] Inventor: Paul M. Demarinis, P.O. Box 424323, San Francisco, Calif. 94142-4323

[21] Appl. No.: 09/237,608

[22] Filed: Jan. 25, 1999

[51] Int. Cl.[7] ..... A63H 5/00

[52] U.S. Cl. ..... 446/397; 446/404; 446/418; 239/211; 239/289

[58] Field of Search ..... 446/81, 153, 176, 446/213, 397, 404, 418, 491; 239/102.2, 211, 289; 40/406; 472/128

[56] References Cited

U.S. PATENT DOCUMENTS 4,294,406 10/1981 Pevnick ..... 239/20

5,060,274 10/1991 Asami et al. ..... 381/166

5,520,089 5/1996 Prentiss ..... 84/330

5,975,682 11/1999 Lee et al. ..... 347/54

*Primary Examiner*—Sam Rivell

*Assistant Examiner*—Jeffrey D. Carlson

*Attorney, Agent, or Firm*—Jerome N. Field, Esq.

[57] ABSTRACT

An interactive entertainment device that utilizes modulated streams of water to produce musical or other sounds. A stream of water is directed through a nozzle in which mechanical vibrations caused by a central magnetic field break up the stream into separate droplets in a controlled manner. These droplets are directed to a membrane which creates audible sound waves.

16 Claims, 8 Drawing Sheets

INTERACTIVE ENTERTAINMENT DEVICE

BACKGROUND OF THE INVENTION

1. Field of the Invention

The present invention relates to an interactive entertainment device that utilizes modulated droplets of water to produce musical or other sounds through the impaction of specially modulated streams of water on a resonating membrane disposed in the water stream.

2. Description of the Prior Art

Since ancient times the combined movement and sound of water has been appreciated as an aesthetic element in fountains and in other applications both utilitarian and recreational. In the renaissance architects and inventors devised a variety of hydraulic means for the production of both pitched and random sounds to enhance the enjoyment of fountains.

In recent decades a number of entertaining arrangements have been constructed to coordinate the movements of water with live or reproduced music. Przystawik (U.S. Pat. No. 3,907,204) describes a musical display fountain that coordinates the movements of water jets in synchronism with colored lights and music via a motor and mechanical linkages. It is not claimed, however, that the music is produced by the water or by the movement of water. Kawamura and others (U.S. Pat. No. 3,292,861) describe a keyboard-like device to control water fountains in synchronism with music via relays and valves. The keyboard permits a human player to accompany a musical performance with prearranged settings of water jets and colored lights. Kawamura makes no claim that the sound is made by the water or the movement of water. Alba (U.S. Pat. No. 5,069,387) describes a cybernetic fountain apparatus that utilizes a microprocessor to coordinate the movements and height of water jets, colored lights and music. The effects produced by the water and light display may be controlled automatically by music fed into the computer, but no claim is made that the water plays any part in reproducing or conducting the sounds of the music.

In each of these systems the sound is presumably reproduced by conventional electronic transducers such as loudspeakers. A disadvantage of this arrangement is that loudspeakers generally must be protected from moisture and consequently must be positioned at some distance from the fountain or other water source. Thus the visual appreciation of the movement of water and the emanation of the sound are separated so that the effect generated by these systems tends to be appropriate only for larger spectacles in which the audience is distanced from the display. Commingling of the water movements and the sound must be accomplished in the mind of the listener. Interaction of the listener with the water and sound is generally precluded. Moreover, none of these devices utilize the water as a primary sound generating medium.

Water has been used as the motive force for activating specific sound producing devices. A musical lawn-sprinkler described by Ochs (U.S. Pat. No. 3,873,026) employs water pressure to move a wheel provided with wire spokes that strike stationary steel tines to create sounds. Here the water provides a source of power to drive a sound producing mechanism, but the water plays no direct part in creating or conducting the sound vibrations. Likewise the musical water faucet of McFarland (U.S. Pat. No. 4,627,326) uses water as the motive force to turn the mechanism of a music box. Again the device does not modulate the water to create the sounds. A related apparatus for making precipitation audible (U.S. Pat. 4,949,385) uses the power of falling rain to ring a set of one or more chimes, but does not use the water itself to create or conduct the sound.

The use of water or other fluids to create or conduct sounds has been proposed in a variety of devices.

A water bed that uses the water to conduct sound from conventional loudspeakers to the user's ear is described by Smith (U.S. Pat. No. 4,507,816). This device employs water only as a conductor of sound that has been conventionally reproduced and does not employ the water itself in creating the sound. Moreover the water is kept relatively motionless and contained within the waterbed and does not contribute visually or refreshingly to any entertainment performed upon the bed.

Prentiss (U.S. Pat. No. 5,520,089) describes a device for producing sounds using the dripping of water into resonant tubes. This has the disadvantage of producing only short percussive sounds and is limited to the set of fixed pitches to which the pipes are tuned.

Audio transducers that use a compressed fluid to create sounds have been proposed. Asami and others (U.S. Pat. No. 5,060,274) describe a hydrostatic speaker that uses a compressed fluid to move a fixed membrane that couples audio signals to the air. The liquid in this device is kept contained within the system, however, and affords no opportunity for water play or visual entertainment. The effect of vibration upon the membrane is caused by the variations in the pressure of the liquid and not by a stream of water. Moreover the device is intended only for the production of super low frequency audio signals. Doi (U.S. Pat. No. 4,194,095) describes a fluid flow control speaker system. The fluid mentioned is air and no mention is made of other fluids such as water, nor of how vibrations from other fluids might be coupled to the air to make the sounds audible. In addition the crux of this patent is direct PCM digital control of sound transduction and thus it uses a plurality of flow pipes to reconstruct a single sound. A patent by Almasy (U.S. Pat. No. 5,073,937) describes a hydrodynamically pressure regulated loudspeaker, but the fluid described in this device only serves as a portion of impermeable boundary to contain an air mass. On the other hand the present device can reproduce sounds recorded on a CD or other medium, and the position can be easily adjusted "interactively" by giving the listener a moveable umbrella which serves as the membrane upon which the water stream impacts to generate variable sound.

None of the prior art creates a continuous and variable variety of sounds that are produced by means of the water itself None of the known prior art systems provide for interactive or immersive participation by the audience. None of the prior art devices can reproduce recorded sound with interactive adjustment by the listener. Water play has been a source of entertainment for countless centuries and the integration of musical, rhythmic or other sounds into this play provides enhanced opportunities for entertainment absent from prior art devices.

SUMMARY OF THE INVENTION

The present invention generally comprises a device through which one or more specially modulated water streams generate sound when the specially modulated water streams impact on a resonator. The water stream modulations are produced by a nozzle and the nozzle-produced modulation are converted in the device to audible sound by a resonator.

The purpose of the invention is to provide a unique interactive means of creating sounds, particularly music, through the impact of water-nozzle produced water modulations on a resonator.

Another purpose of this invention is to provide an amusement device which creates and modifies sound, particularly music, through the impact of a specially modulated water stream on a resonator positioned by the listener to alter the nature of the generated music.

Additional objects and advantages will become apparent and a more thorough and comprehensive understanding may be had from the following description read in conjunction with the accompanying drawings forming a part of this specification.

PRINCIPLE OF OPERATION

A pressurized source of water flows through a flexible hose into the nozzle assembly. The nozzle is vibrated longitudinally by the action of the magnetic field produced by the electromagnet upon the permanent magnet that is fixed to the nozzle tube. This imparts an ordered vibration to the water that corresponds to the excitation frequency being fed to the electromagnetic coil. The water itself radiates very little sound, but when the stream of water falls on a resonating membrane such as an umbrella, the membrane is made to vibrate at a corresponding frequency and these vibrations, coupled acoustically to the air are plainly audible to the listener.

The device operates by the modulation of droplets of water as they depart from the continuous stream leaving the nozzle. The mechanical vibrations imposed at the nozzle cause the water stream to break up into separate droplets whose spacing apart is analogous to the excitation sound wave. These droplets, falling on the stretched membrane cause the membrane to vibrate creating audible sound waves in the air corresponding in frequency to the excitation sound waves. The membrane may be moved to vary the produced sound.

DETAILED DESCRIPTION OF DRAWINGS AND PREFERRED EMBODIMENT

Figure 1:
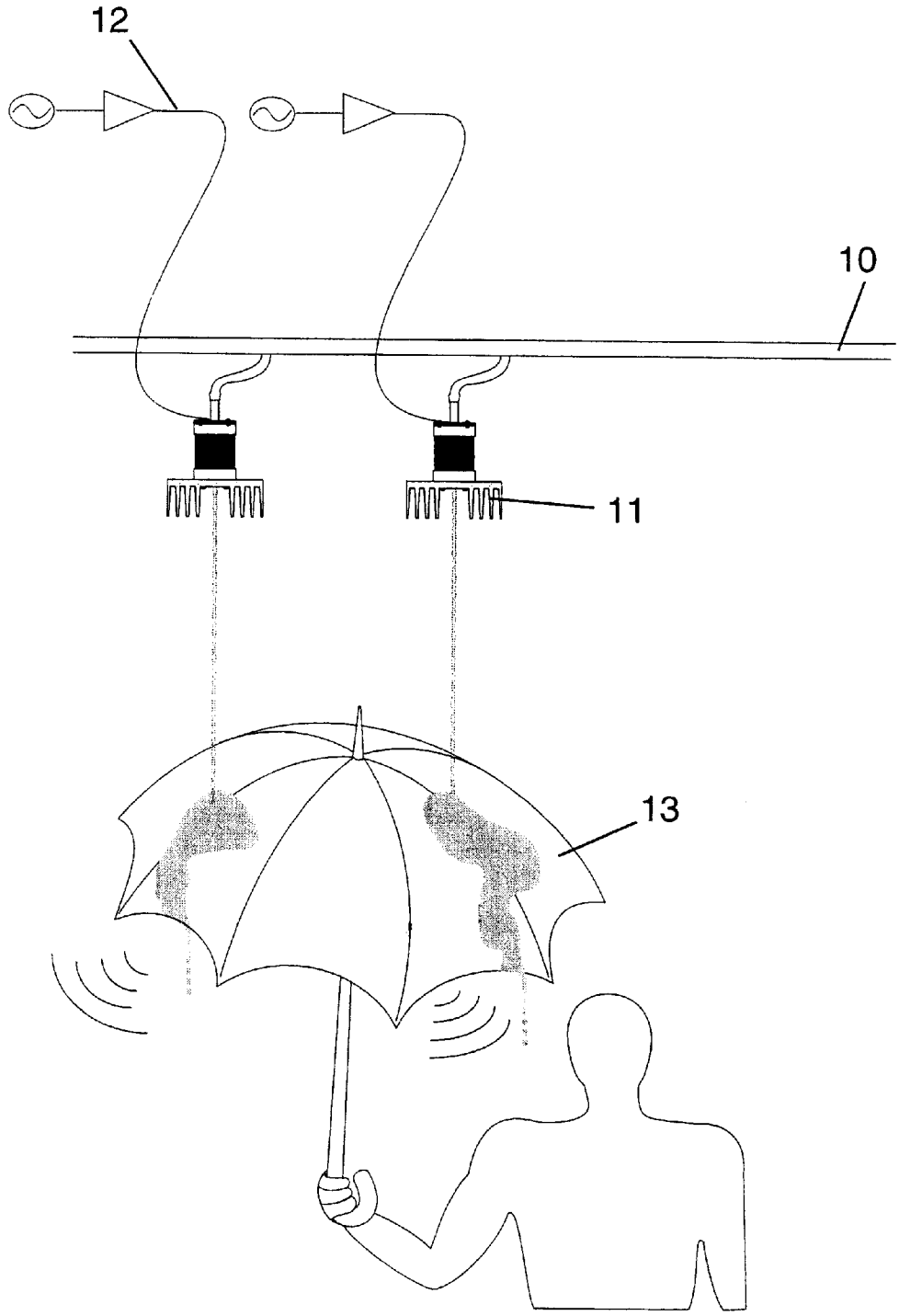
FIG. 1 is a schematic view of the system showing the audio source, modulating nozzle and umbrella which serves as the sound altering membrane controlled by the listener.
Figure 2:
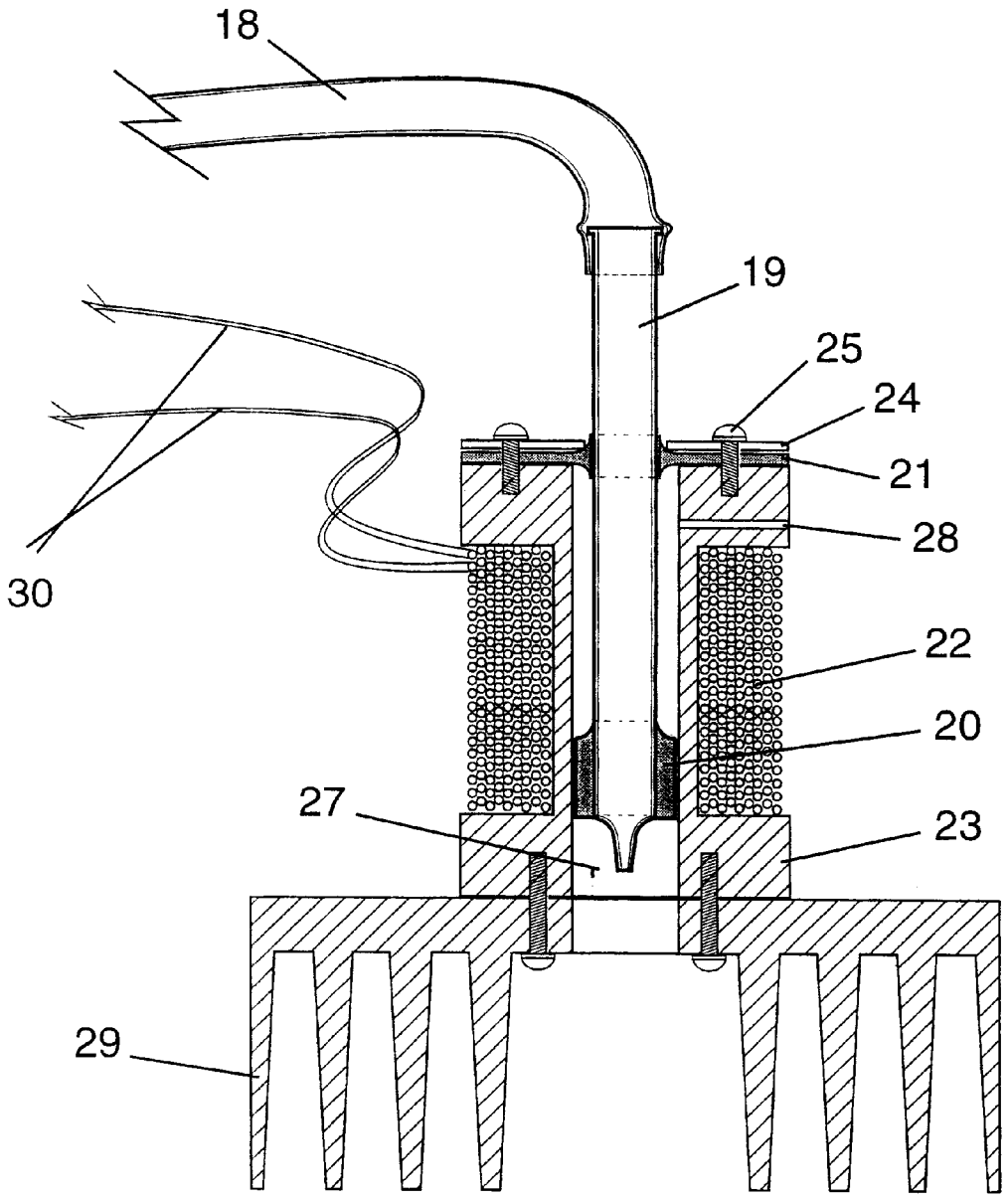
FIG. 2 is a frontal view in cross section through the modulating nozzle showing details of working parts.
Figure 3:
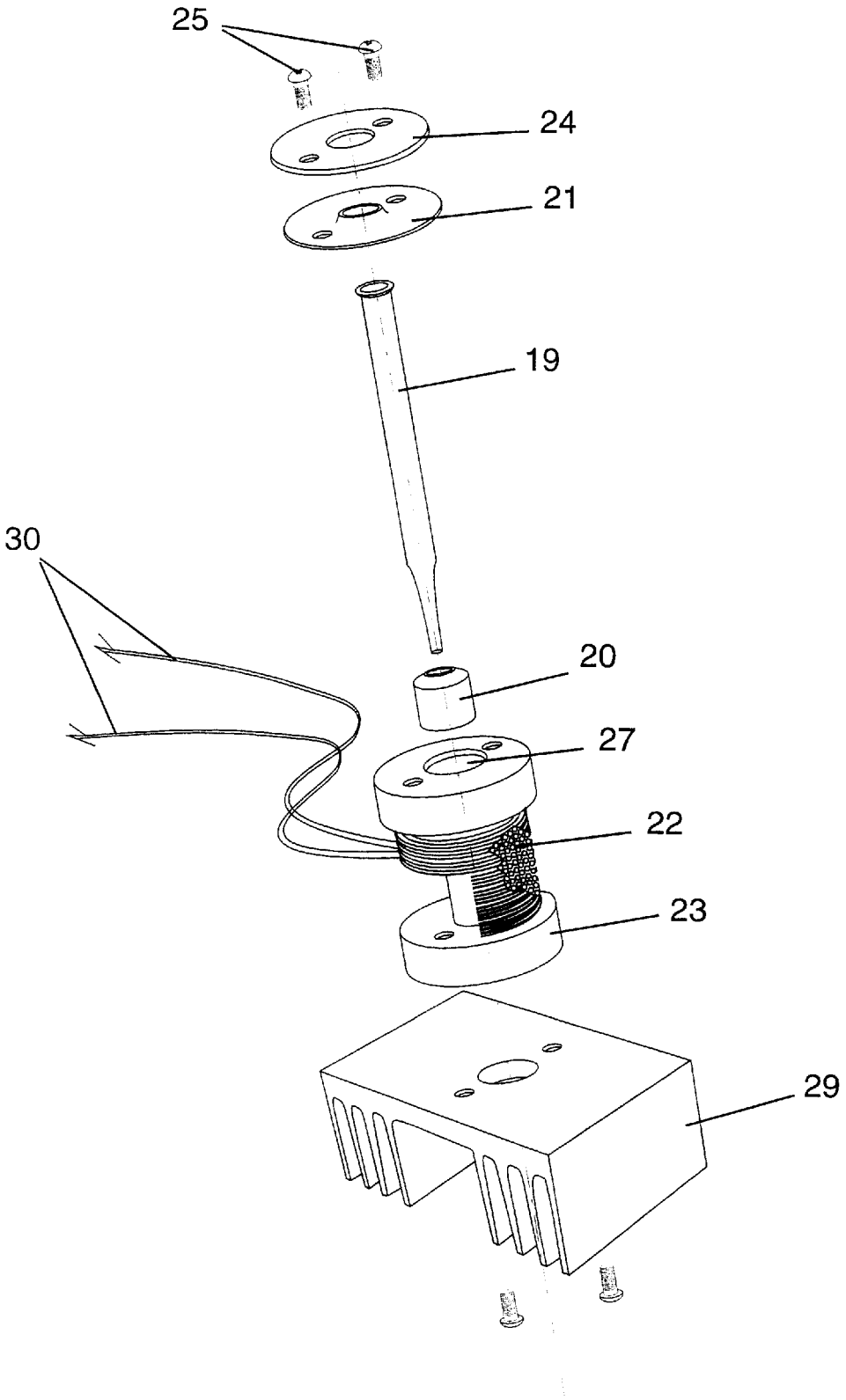
FIG. 3 is an exploded perspective view of the nozzle.
Figure 4:
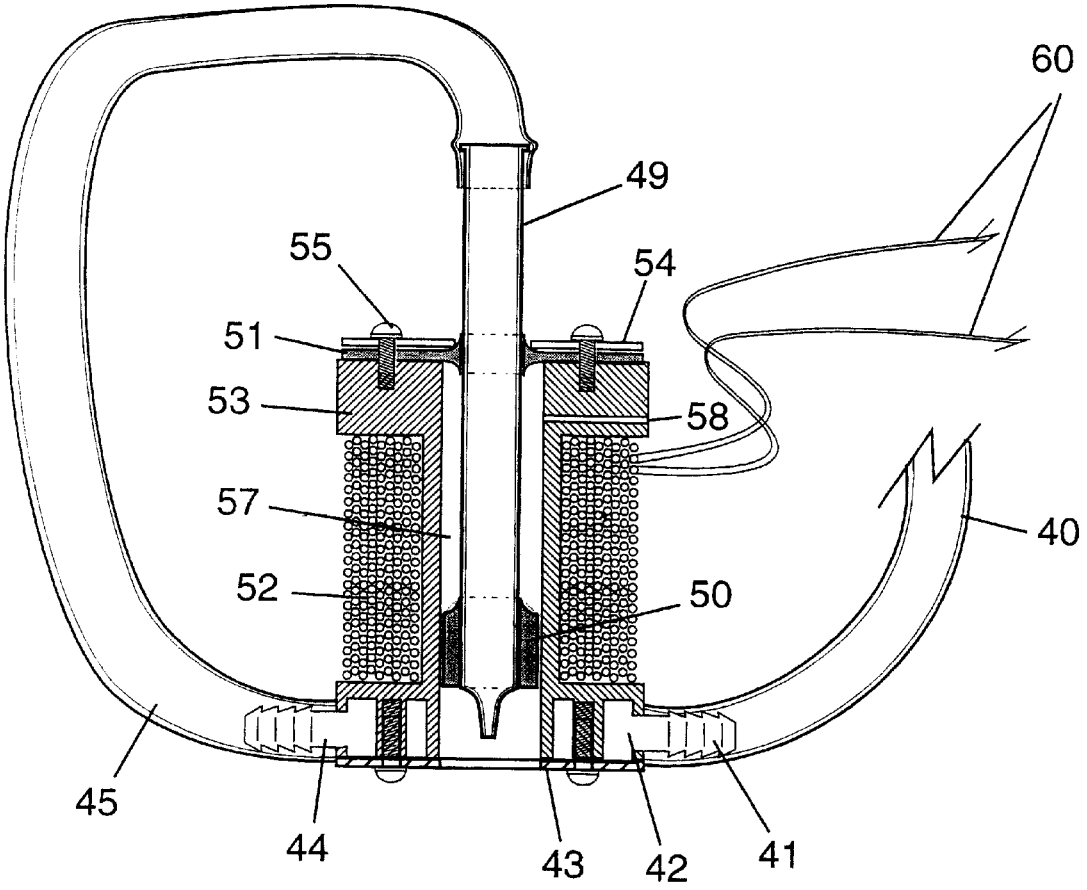
FIG. 4 is a frontal view in cross section showing one embodiment of the modulating nozzle construction.
Figure 5:
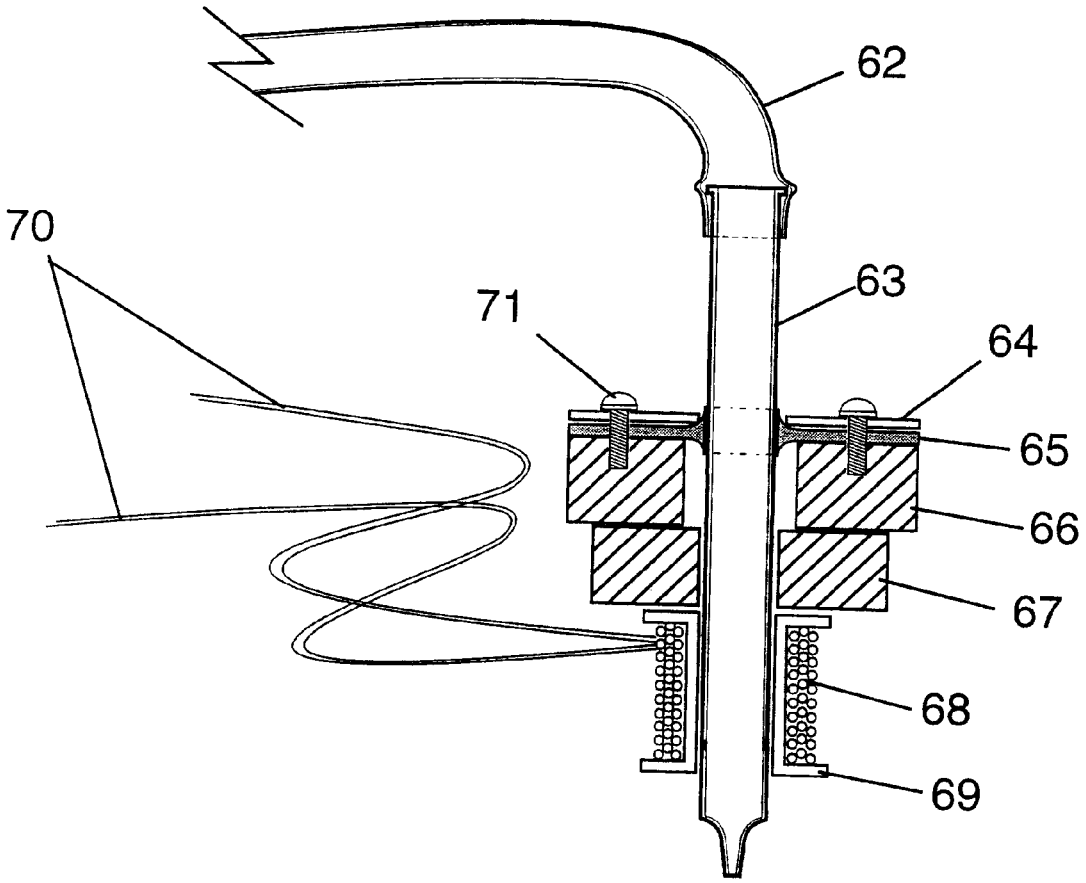
FIG. 5 is a frontal view in cross section showing an alternate embodiment of the nozzle construction.
Figure 6:
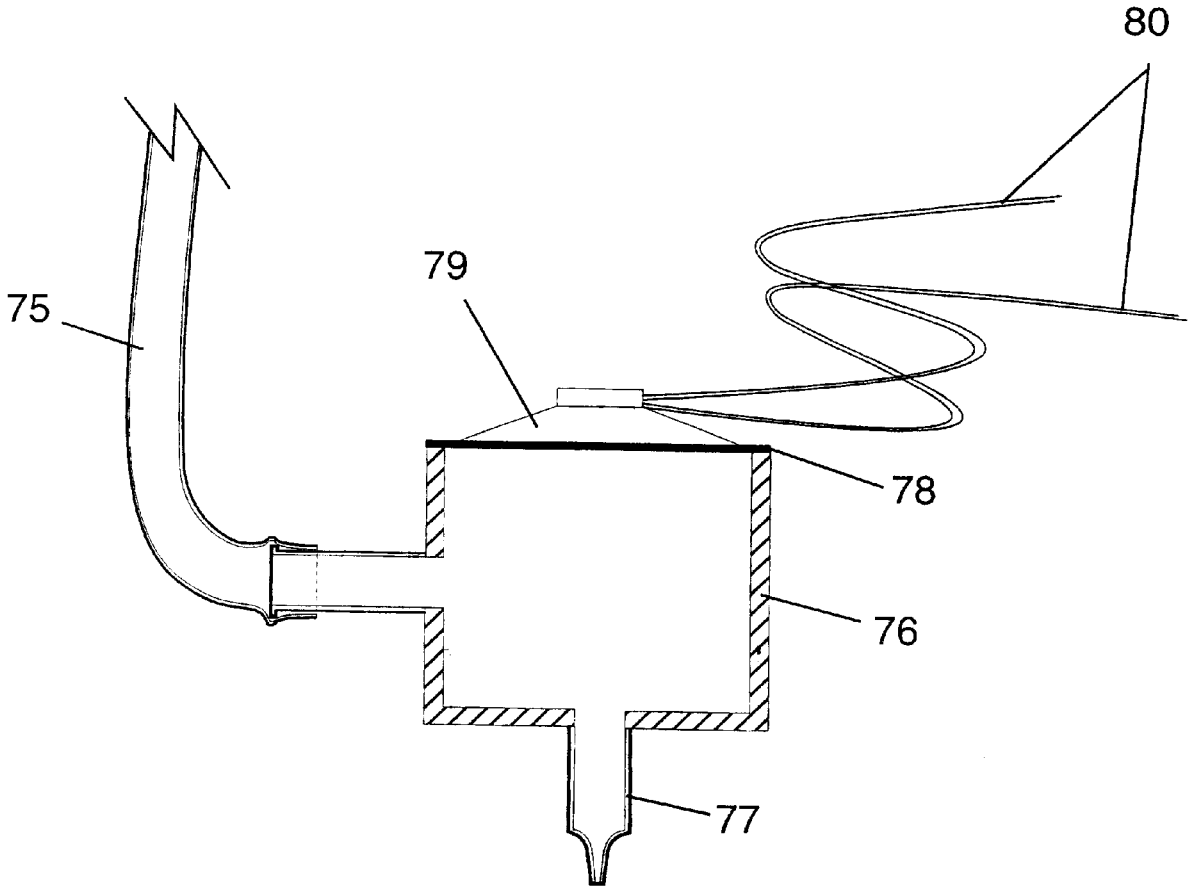
FIG. 6 is a frontal view showing an alternate mode of compression
Figure 7:
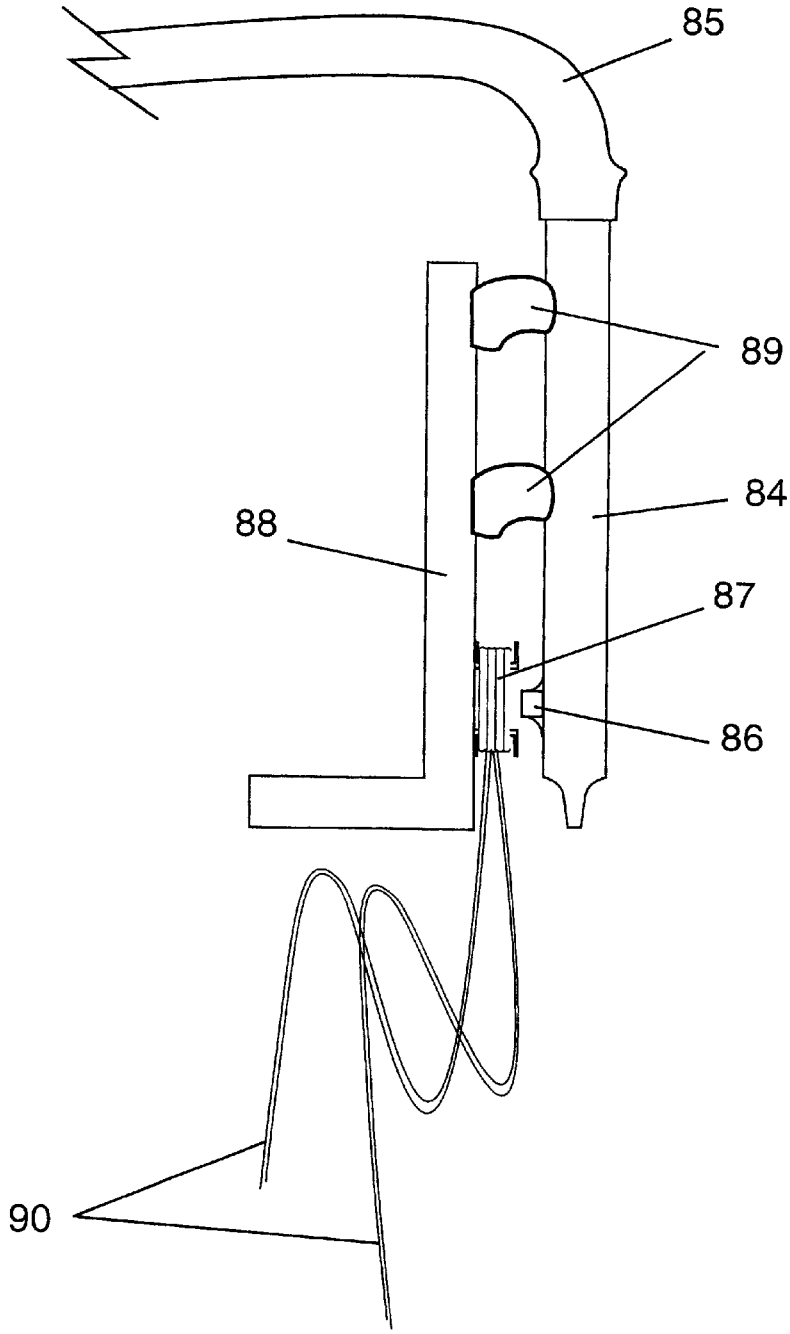
FIG. 7 is a frontal view showing structure for imparting audio information to the water stream.
Figure 8:
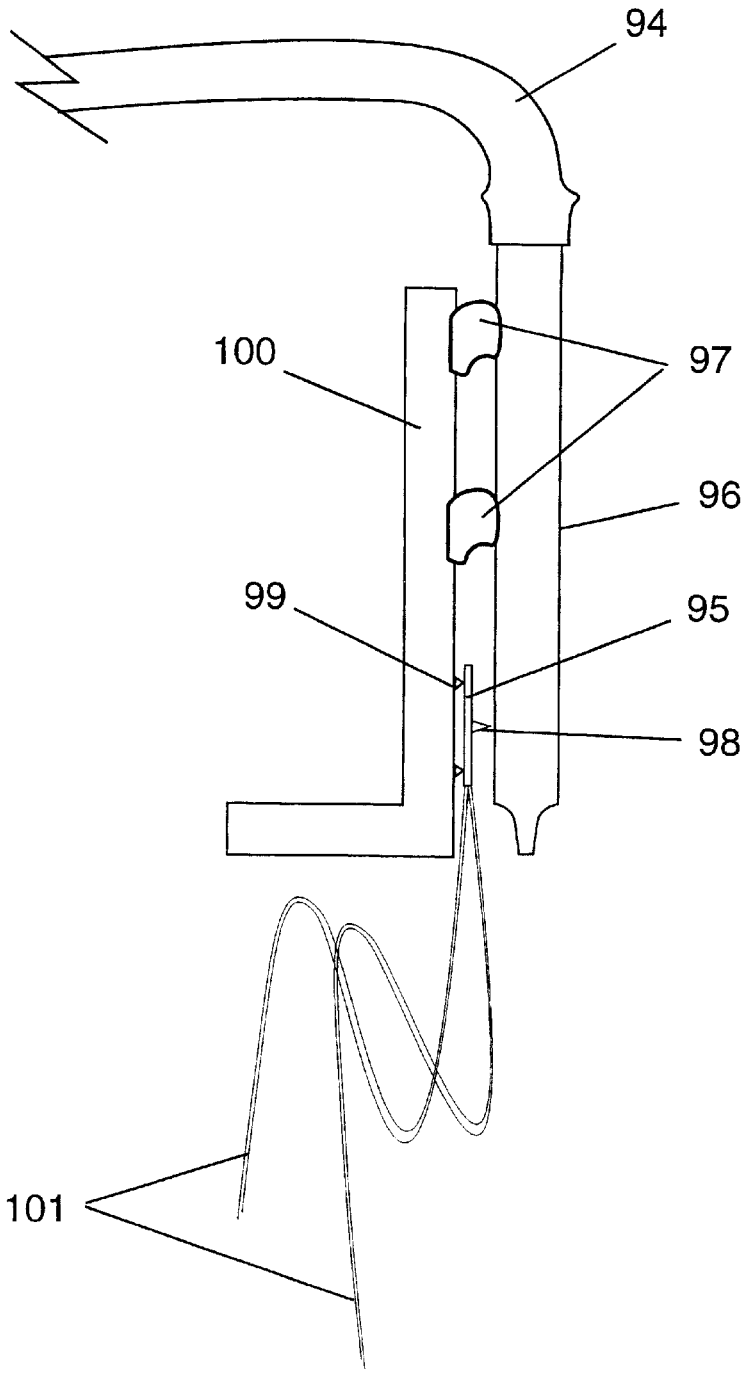
FIG. 8 is a frontal view showing alternate structure for imparting audio information to the water stream.

The invention employs specially modulated water streams to produce sounds when the water falls on a resonator. The modulations are produced by a modulating nozzle and converted into audible sounds by means of the resonator. Referring to FIG. 1, the system consists of a source of pressurized water 10, a modulating nozzle assembly generally indicated at 11 controlled by electronic circuitry 12 and a moveable or fixed resonator incorporating a stretched membrane or other device 13 that serves to couple vibrations to the air and make them audible. FIGS. 2, 3 and 4 show the preferred embodiment of the invention. FIG. 3 is an exploded view of FIG. 2 and FIG. 4 shows the preferred cooling system. FIG. 4 uses a different cooling system from FIGS. 2 and 3. It can be considered an alternate cooling system to the cooling system shown in FIGS. 2 and 3. Referring to FIGS. 2 and 3 the parts of the modulating nozzle are a flexible hose 18, a tube with a nozzle at one end 19, a magnet 20, a gasket 21 and an electromagnetic coil 22 wound around a bobbin 23; and seals, fasteners and connectors to connect the above parts. For example gasket 21 is fixedly secured in place by retaining washer 24 and screws 25. A rigid tube made of glass, or some other material such as metal or plastic has a connection for a flexible hose at one end and a nozzle of reduced diameter attached to, or integrally formed into, the opposite end. An axially polarized permanent magnet 20 with a central hole through its longitudinal axis is rigidly affixed around this tube at the nozzle end. The electromagnetic coil 22 is wound around the bobbin 23 made of a nonferrous metal or other material. The bobbin is provided with a central channel 27 that allows the tube 19 and magnet assembly 20 to be positioned inside it. The diameter of this channel is slightly larger than the outer dimensions of the magnet to permit the magnet to slide within it. The approximate difference is ten one-thousandths of an inch. The tube with nozzle 19 has a flexible gasket 21 attached to, or integrally formed into, it that allows it to move slightly longitudinally within channel 27. This gasket serves to retain the tube in proper position vis a vis the magnetic coil 22 while allowing it some limited excursion. The gasket 21 also serves to center the tube axially within the channel 27. The gasket 21 is held in place by a retaining washer 24 made of metal or other material, and having a central hole sufficient for the tube to pass through and several screw holes through which screws pass into the threaded holes in the bobbin to secure the gasket position. Optionally, the tube with nozzle 19 is further centered at the magnet end by a quantity of ferrofluid sufficient to displace the air gap between the magnet and the walls of the channel 27. The preferred ferrofluid is FerroSound manufactured by Ferrofluidics Inc. An optional vent hole 28 can be provided in the bobbin if ferrofluid is used to allow air to enter and exit the air chamber thus formed by the gasket on one end and the seal created by the ferrofluid and the magnet on the other. The electromagnetic coil 22 is activated by wires 30 to a power amplifier fed with an audio frequency signal derived from an audio source such as a compact disc player, synthesizer or computer. The audio signal may be enhanced by equalization. The optimal source signal will be a sine wave, but other waveforms reproduce with varying clarity. The corresponding magnetic flux changes in the coil cause the tube assembly to move slightly in and out of the electromagnetic coil, which is held rigid. The water exiting from the nozzle end of the tube has imparted to it vibrations which correspond to the sound vibrations of the source signal. The water exiting from the nozzle falls upon a resonator such as a stretched membrane shown in FIG. 1 as an umbrella 13, producing sounds closely resembling the audio frequencies fed to the power amplifier. The angle of the stream of water may be directed and may vary from vertical to horizontal to direct it to membranes in different positions. Referring to FIGS. 2 and 3 a passive heat sink 29 is connected to the electromagnet assembly to dissipate the heat caused by the flow of electric current through the electromagnet coil. An optional cooling chamber 42 shown in FIG. 4 may be provided within the body of the bobbin for cooling water to pass through. This water may derive from a separate supply or may be the pressurized water used to feed the tube and nozzle assembly. In the latter case the water is fed from a flexible tube or rigid hose 40 into the cooling chamber 42 and from the cooling chamber via a flexible hose 45 into the tube of the nozzle 49. FIG. 4 is exactly the embodiment shown in FIGS. 2 and 3 except that the passive heat sink is replaced by a cooling chamber 42 built into the bobbin 53 together with the sealing washer 43 through which the water passes on its way to the nozzle 49, thus removing heat. More precisely, FIG. 4 shows the water supply connected via a barbed fluid connector 41 into the cooling chamber 42. The water circulates through this chamber 42 which is formed into the bobbin together with the sealing washer 43, removing heat from the electromagnetic coil 52. The water exits the cooling chamber 42 through an outlet formed by a barbed fluid connector 44 into a flexible hose 45 that feeds the tube and nozzle assembly 49. Referring to FIG. 4 the parts of the modulating nozzle assembly are a flexible hose 45, a tube with a nozzle at one end 49, a magnet 50, a gasket 51 and an electromagnetic coil 52 wound around a bobbin 53; and seals, fasteners and connectors to connect the above parts. For example gasket 51 is fixedly secured in place by retaining washer 54 and screws 55. A rigid tube made of glass, or some other material such as metal or plastic has a connection for a flexible hose at one end and a nozzle of reduced diameter attached to, or integrally formed into, the opposite end. An axially polarized permanent magnet 50 with a central hole through its longitudinal axis is rigidly affixed around this tube at the nozzle end. The electromagnetic coil 52 is wound around the bobbin 53 made of a nonferrous metal or other material. The bobbin is provided with a central channel 57 that allows the tube 49 and magnet assembly 50 to be positioned inside it. The diameter of this channel is slightly larger than the outer dimensions of the magnet to permit the magnet to slide within it. The approximate difference is ten one-thousandths of an inch. The tube with nozzle 49 has a flexible gasket 51 attached to, or integrally formed into, it that allows it to move slightly longitudinally within channel 57. This gasket serves to retain the tube in proper position vis a vis the magnetic coil 52 while allowing it some limited excursion. The gasket 51 also serves to center the tube axially within the channel 57. The gasket 51 is held in place by a retaining washer 54 made of metal or other material, and having a central hole sufficient for the tube to pass through and several screw holes through which screws pass into the threaded holes in the bobbin to secure the gasket position. Optionally, the tube with nozzle 49 is further centered at the magnet end by a quantity of ferrofluid sufficient to displace the air gap between the magnet and the walls of the channel 57. The preferred ferrofluid is FerroSound manufactured by Ferrofluidics Inc. An optional vent hole 58 can be provided in the bobbin if ferrofluid is used to allow air to enter and exit the air chamber thus formed by the gasket on one end and the seal created by the ferrofluid and the magnet on the other. The electromagnetic coil 52 is activated by wires 60 connected to a power amplifier fed with an audio frequency signal derived from an audio source such as a compact disc player, synthesizer or computer. The audio signal may be enhanced by equalization. The optimal source signal will be a sine wave, but other wave forms reproduce with varying clarity. FIG. 5 is an alternate embodiment of the invention in which the position of the electromagnetic coil and the permanent magnet are reversed. In FIG. 5 the electromagnetic coil 68 is rigidly attached to the nozzle 63 and the nozzle assembly is positioned to move relative to the permanently fixed assembly, i.e. the magnet 67. In contradistinction thereto in FIGS. 2, 3 and 4 the permanent magnet 68 is fixed to the nozzle. A flexible gasket 65 attached or formed into the nozzle allows some measure of movement with respect to the fixed assembly comprised of the mount 66 and the magnet 67. The flexible gasket 65 is held in place by a retaining washer 64 and screws 71. The audio information may be imparted to the water stream in several alternative ways, either by compression of the fluid or vibration of the nozzle from which the fluid stream exits. In the case of compression, the electromagnetic driver is positioned to modulate the size of the a fluid chamber that feeds the nozzle or to vary the pressure with which the fluid leaves the nozzle. FIG. 6 shows an alternate embodiment for compression. Referring to FIG. 6, a hose 75 feeds a cubic chamber 76 which is rigidly constructed on five of its six sides. A nozzle 77 rigidly fixed to one side provides an outlet for the water stream. The non-rigid side of the chamber is provided with a waterproof flexible membrane 78 and a loudspeaker 79. Wires 80 connect the loudspeaker to an audio amplifier. The loudspeaker interacting with the flexible membrane vibrates the chamber which is water filled thereby affecting the pressure at the outlet nozzle thus imparting the audio information through the modulated water stream. FIGS. 7 and 8 show alternative methods of imparting audio information to the water stream. In FIG. 7 the audio information is imparted by vibrating the nozzle laterally, whereas in FIG. 6 the outlet through which audio information is conveyed is fixed. It vibrates laterally thereby imparting audio information to the water stream. In FIG. 7 the nozzle 84 which vibrates is shown connected to the water feed hose 85. A magnet 86 is fixed rigidly to the nozzle and a proximate electromagnetic coil 87 causes the proximate portion of the nozzle to vibrate laterally thereby imparting the audio information to the water stream exiting the nozzle. In FIG. 7 a rigid mount for the device is shown at 88 with flexible silicone elastic bonds 89 which hold the nozzle so that it may vibrate laterally. An electromagnetic or piezoelectric transducer may be connected to the nozzle so as to cause the nozzle to physically vibrate wither laterally or axially. Axially is the preferred method. This transducer may be a separate unit or formed partially or wholly into the nozzle assembly. In the case of an electromagnetic transducer, either the magnet or the coil may be attached to the nozzle, the other component remaining fixed. In FIGS. 7 and 8 the nozzle is moving laterally as distinguished from FIGS. 2,3,4 and 5 in which the nozzle moves axially. In FIG. 6 the nozzle is fixedly secured, i.e. it does not move either laterally or axial, rather the pressure of the water in the chamber imparts information to the water stream. FIG. 8 is a modification of the embodiment shown in FIG. 7. In FIG. 8 a piezo electric transducer 95 replaces the combination transducer shown in FIG. 7, i.e., the magnet and coil. The vibrating nozzle 96 and flexible silicone mounts 97 are, for all practical purposes, identical with those shown in FIG. 7 The piezo electric transducer 95 shown in FIG. 8 is operatively engaged with the nozzle 96 by a point contact 98 with a base 99 fixedly secured around its rim to the mount 100. Wires 101 connect the piezoelectric transducer to an audio amplifier causing the transducer to vibrate. The vibrations are conducted by the point contact 98 to the proximate end of the tube and nozzle assembly 96. Water entering the tube and nozzle assembly 96 through the flexible hose 94 exits from the reduced nozzle end having sound vibrations imparted to it. The resonating device may be fixed under the stream or made portable for interactive participation. A simple device such as an open cylinder with a flexible membrane stretched across it or formed integrally into it may be used. Or the resonating membrane may take the form of an umbrella or other device such as a special hat which can be positioned interactively by the listener and at the same time provide some measure of protection from the wetting effect of the water, if desired. The roof and walls of a stationary structure or moving vehicle may also serve as the resonator. An interactive exhibit of a single or a number of these streams may be provided so that listeners can move from one stream to the other in a random or pre arranged sequence. Additionally, the audio signals sent to the respective modulating nozzles may be coordinated so as to produce interlocking musical parts that combine in novel and pleasant ways. The exhibit provides for a variety of entertaining activities including but not limited to, listening to music or other sounds, water play and the mixing of sounds together by combining water streams. of entertaining activities including but not limited to, listening to music or other sounds, water play and the mixing of sounds together by combining water streams.

I claim:

1. An interactive entertainment device that utilizes droplets of water to produce sound comprising:

pressurized water directed through a flexible water hose into a nozzle assembly;

a nozzle assembly comprising a water tube open at each end, fixedly attached to said flexible water hose at one end and tapered at the other end to a reduced diameter, a power amplifier which is fed audio signals means to convert said audio signals into physical vibration of the tube and the water therein; and a resonator positioned adjacent to the tapered end of the water tube of the nozzle assembly whereby water drops exiting the nozzle impact on said resonator producing sound.

2. The interactive entertainment device of claim 1 wherein said nozzle assembly is provided with an aligned ring-shape magnet through which said water tube passes, a bobbin provided with an aligned central channel through which said water tube passes, said ring-shaped magnet slidably aligned within said central channel, said magnet having a diameter slightly less than the diameter of the central channel of said bobbin, a rigidly disposed electromagnetic coil wound axially around said bobbin, a power amplifier fed with an audio frequency source operatively attached to said electromagnet coil, whereby magnetic flux changes in the coil cause said water tube to axially move in and out of the coil thereby imparting vibrations to the water corresponding to the sound vibrations of the source signal.

3. The interactive entertainment device of claim 1 wherein the nozzle assembly is provided with an aligned ring-shaped magnet through which said water tube passes, a bobbin provided with an aligned central channel through which said water tube passes, said bobbin being fixedly secured to said water tube and slidably aligned with said ring-shaped magnet, a rigidly disposed electromagnetic coil wound axially around said bobbin, a power amplifier fed with an audio frequency source operatively attached to said electromagnetic coil, whereby magnetic flux changes in the coil cause said water tube to axially move with respect to said ring-shaped magnet thereby imparting vibrations to the water corresponding to the sound vibrations of the source signal.

4. The interactive entertainment device of claim 1 wherein said nozzle assembly is provided with a a chamber having an inlet for pressurized water and a tapered outlet tube, the side of said chamber opposite said outlet tube comprising a flexible waterproof membrane operatively fixed to a loudspeaker, a power amplifier fed with an audio frequency source operatively attached to said loudspeaker, whereby vibrations are imparted to the water corresponding to the sound vibrations of the source signal.

5. The interactive entertainment device of claim 1 wherein said water tube is provided with a flexible mounting to permit lateral movement, a permanent magnet fixedly secured to said water tube, an electromagnetic coil disposed proximate to said fixed permanent magnet, and a power amplifier fed with an audio frequency source operatively attached to said electromagnetic coil, whereby magnetic flux changes in the coil cause said water tube to move laterally thereby imparting vibrations to the water corresponding to the sound vibrations of the source signal.

6. The interactive entertainment device of claim 2 wherein said water tube is positioned by a flexible gasket to provide longitudinal movement within the central channel of said bobbin.

7. The interactive entertainment device of claim 2 wherein the gap between the ring-shaped magnet and the inner walls of the central channel of the bobbin is filled with ferrofluid.

8. The interactive entertainment device of claim 2 wherein a passive heat sink is operatively connected to said electromagnetic coil to dissipate heat generated by the flow of electric current through said electromagnetic coil.

9. The interactive entertainment device of claim 2 wherein said bobbin is provided with a cooling chamber operatively connected to the electromagnetic coil to dissipate heat generated by the flow of electric current through said electromagnetic coil.

10. The interactive entertainment device of claim 1 wherein the audio frequency source fed to said power amplifier is a compact disc player.

11. The interactive entertainment device of claim 1 wherein the audio frequency source fed to said power amplifier is a synthesizer.

12. The interactive entertainment device of claim 1 wherein the audio frequency source fed to said power amplifier is a computer.

13. A nozzle assembly for modifying water flow to produce sound upon impact with a resonator comprising:

a water tube open at each end, fixedly attached to a flexible water hose at one end and tapered at the other end to a reduced diameter;

an aligned ring-shaped magnet through which said water tube passes;

a bobbin provided with an aligned central channel through which said water tube passes, said ring-shaped magnet slidably aligned within said central channel, said magnet having a diameter slightly less than the diameter of the central channel of said bobbin;

a rigidly disposed electromagnetic coil wound axially around said bobbin;

a power amplifier fed with an audio frequency source operatively attached to said electromagnetic coil, whereby magnetic flux changes in the electromagnetic coil cause said water tube to move in and out of the electromagnetic coil thereby imparting vibrations to the water corresponding to the sound signal.

14. The interactive entertainment device of claim 13 wherein the nozzle assembly is provided with an aligned ring-shaped magnet through which said water tube passes, a bobbin provided with an aligned central channel through which said water tube passes, said bobbin being fixedly secured to said water tube and slidably aligned with said ring-shaped magnet, a rigidly disposed electromagnetic coil wound axially around said bobbin, said power amplifier fed with an audio frequency source operatively attached to said electromagnetic coil, whereby magnetic flux changes in the coil cause said water tube to axially move with respect to said ring-shaped magnet thereby imparting vibrations to the water corresponding to the sound source signal.

15. The interactive entertainment device of claim 13 wherein said nozzle assembly is provided with a chamber having an inlet for pressurized water and a tapered outlet tube, the side of said chamber opposite said outlet tube comprising a flexible waterproof membrane operatively fixed to a loudspeaker, said power amplifier fed with an audio frequency source operatively attached to said loudspeaker, whereby vibrations are imparted to the water corresponding to the sound source signal.

16. The interactive entertainment device of claim 13 wherein said water tube is provided with a flexible mounting to permit lateral movement, a permanent magnet fixedly secured to said water tube, an electromagnetic coil disposed proximate to said fixed permanent magnet, and said power amplifier fed with an audio frequency source operatively attached to said electromagnetic coil, whereby magnetic flux changes in the coil cause said water tube to move laterally thereby imparting vibrations to the water corresponding to the sound source signal.

* * * * *